US005464328A

United States Patent [19]

Stoeger

[11] Patent Number: 5,464,328

[45] Date of Patent: Nov. 7, 1995

[54] REGULATING AND CONTROLLING DEVICE FOR A FLUID PRESSURE BOOSTER INSTALLATION

[76] Inventor: Helmut Stoeger, Herzogstandstrasse 16, 82362 Weilheim, Germany

[21] Appl. No.: 201,646

[22] Filed: Feb. 25, 1994

[30] Foreign Application Priority Data

Mar. 29, 1993 [DE] Germany ..... 43 10 155.0

[51] Int. Cl.[6] ..... F04B 49/06

[52] U.S. Cl. ..... 417/44.8; 417/12; 417/304

[58] Field of Search ..... 417/12, 44.8, 304

[56] References Cited

U.S. PATENT DOCUMENTS

| | | | |
|---|---|---|---|
| 1,486,533 | 3/1924 | Muffly | 417/44.8 |
| 2,356,306 | 8/1944 | Davis | 417/44.8 |
| 2,482,732 | 9/1949 | Hollerith | 417/44.8 |
| 2,485,074 | 10/1949 | Stevenson | 417/44.8 |
| 2,639,083 | 5/1953 | Rambo | 417/44.8 |
| 3,294,104 | 12/1966 | Mercier | 417/304 |
| 3,446,238 | 5/1969 | Nostrud et al. | 417/44.8 |
| 3,469,528 | 9/1969 | East | 417/44.8 |
| 3,521,975 | 7/1970 | Sicho | 417/44.8 |
| 3,694,105 | 9/1972 | Martin | 417/44.8 |
| 4,476,889 | 10/1984 | Haynes | 417/44.8 |

FOREIGN PATENT DOCUMENTS

| | | | |
|---|---|---|---|
| 3335895 | 4/1985 | Germany | 417/304 |
| 329845 | 5/1930 | United Kingdom | 417/304 |

*Primary Examiner*—Richard A. Bertsch
*Assistant Examiner*—Xuan M. Thai
*Attorney, Agent, or Firm*—McAulay Fisher Nissen Goldberg & Kiel

[57] ABSTRACT

A regulating and controlling device for a fluid pressure booster installation includes a motor-driven pressure generating unit, a check valve, a relief valve and a pressure switch. The pressure switch has a first cylinder-piston arrangement for connecting the drive motor to a source of electrical energy. The first cylinder-piston arrangement includes a piston rod for contacting an intermediate member. The device has, as an improvement, a second cylinder-piston arrangement, a third cylinder-piston arrangement and a gear unit. The improvement prevents longer-lasting circulation delivery and, accordingly, an overheating of the working fluid. This also avoids any need for the pressure switch to be constructed so as to be adjustable in operation with respect to switch-off pressure or any need to be adjusted when changing the pressure value of the relief valve used for adjusting the pressure at the pressure outlet of the device.

11 Claims, 9 Drawing Sheets

REGULATING AND CONTROLLING DEVICE FOR A FLUID PRESSURE BOOSTER INSTALLATION

BACKGROUND OF THE INVENTION

Field of the Invention

The invention is directed to a regulating and controlling device for a fluid pressure booster installation, in particular a high-pressure cleaning installation containing a pressure generating unit with a pump which is driven by a motor, the working fluid whose pressure is to be increased being fed to the suction connection of the pump, and the pressure connection of the pump is connected with a check valve whose outlet side is connected to the pressure outlet of the installation from which the working fluid can be removed at high pressure, a relief valve which can be adjusted with respect to pressure as appropriate for operation, the input of the relief valve being connected with the pressure connection, its output being connected with the suction connection, and its control input being connected with the outlet side of the check valve, and a pressure switch with a large ON-OFF switching differential which connects the motor to the mains and contains a first cylinder-piston arrangement which is connected with the outlet side of the check valve and whose piston rod can contact an intermediate member which is movably supported in the switch frame and pretensioned in the direction of a first limit position by means of a first spring and coupled with a movable contact carrier via a snap-in or locking arrangement, wherein the intermediate member moves the contact carrier from its ON position into an OFF position in a movement which proceeds from the first limit position occupied by the cylinder-piston arrangement in the absence of pressure and is directed toward the second limit position, and wherein the intermediate member moves the contact carrier into the ON position before reaching the first limit position at a first lower pressure with a reverse movement which is effected by the drive of the first spring against the oppositely directed force of the cylinder-piston arrangement, and wherein the intermediate member, proceeding from a position predetermined by the first cylinder-piston arrangement, can be moved farther in the direction of its second limit position by an external force simply by overcoming the sum of the spring forces of the first spring and locking arrangement.

BACKGROUND ART

Such regulating and controlling devices as described above are known. The problem of short-period on-and-off switching processes (stop-and-go operation) can be eliminated at least to some degree by using a pressure switch with a large ON-OFF switching differential which, for example, assumes the OFF position at a pressure of 150 bar and the ON position at a pressure of 20 bar (or by using two separate suitably adjusted pressure switches for the switch-on process and switch-off process). The reason for this stop-and-go operation is that pressure booster installations generally do not contain any accumulator component parts such as a gas-loaded storage tank. In practice, only hose connections which may be present in the installation work in this way and slightly increase the enclosed volume at an increase in pressure due to the expansion of the walls. Therefore, if the pump has brought the working fluid to a nominal pressure of 150 bar, for example, and was then switched off by the pressure switch, minimal leakage at the outlet valve in the conventional pressure switches would already be enough to cause a large drop in pressure so that the pump would be switched on again. This damaging effect is mitigated by pressure switches with a large ON-OFF switching differential, since this lengthens the switching periods.

In the known controlling and regulating devices, it is common to enable variation of the operating pressure provided by the system by adjusting the response pressure of the relief valve. However, when no further arrangements are made, an adjustment of the operating pressure of the relief valve to a value below the switch-off pressure of the pressure switch prevents the pressure switch from ever moving to the OFF position. The motor and pump are therefore permanently switched on, even when no working fluid is being removed from the installation. In the latter case, the pump delivers a relatively small volume of working fluid into a closed circuit which leads from the pump pressure connection back to the pump suction connection via the relief valve. This leads after a short time to a considerable heating of this fluid volume and the pump etc., which can have harmful consequences for the piston seals of the pump in particular and, in combination with permanent running, can lead to premature failure.

A known attempt to overcome this problem consists in the use of a specially constructed relief valve containing a limit switch which is controlled by the valve spindle which is movable against the valve spring in a pressure-dependent manner. The limit switch causes the motor to be switched off at a given, generally small spindle lift. Since the spindle responds already to small changes in pressure and accordingly also causes the pressure switch to change its switching state, the motor keeps switching on and off. Again, it is known to counteract this on-and-off switching by means of an additional pressure switch. Thus, in addition to a switch protection, a plurality of pressure switches are required, since the available force at the spindle of the relief valve is only sufficient for driving an auxiliary limit switch.

OBJECT AND SUMMARY OF THE INVENTION

The primary object of the present invention is to develop a regulating and controlling device of the type mentioned above so as to prevent a longer-lasting circulating delivery and accordingly an overheating of the working fluid and also in such a way that the pressure switch need not be constructed so as to be adjustable in operation with respect to its switch-off pressure and also need not be readjusted when changing the pressure value setting of the relief valve used for adjusting the pressure at the pressure outlet of the installation.

This object is met, according to the invention, by means of a second cylinder-piston arrangement having a stationary second cylinder, the pressure connection of the second cylinder-piston arrangement being connected with the outlet side of the check valve and its piston-piston rod unit, which is pretensioned by a second spring against an inner stop defining the moved in state, is lifted from the inner stop when the pressure connection is acted upon by a second lower pressure and comes to rest at an outer stop at a slightly greater second upper pressure, a third cylinder-piston arrangement having a stationary third cylinder, whose pressure connection is connected with the pressure connection of the pressure generating unit, whose piston-piston rod unit which is pretensioned by a third spring against an inner stop defining the moved in state is lifted from the inner stop when the pressure connection is acted upon by a third lower pressure and comes to rest at an outer stop at a slightly greater third upper pressure, wherein the third upper pressure is greater than the first lower pressure (switch-on pressure) and less than the second upper pressure, a gear unit arrangement which is driven by the second piston-piston rod unit and by the third piston-piston rod unit and has a trigger element which can engage at the intermediate member of the pressure switch, wherein the trigger element can be moved from an inactive limit position situated outside of the movement path of the intermediate member into an active limit position in which it acts on the intermediate member with a pressing surface so as to move the intermediate member toward its second limit position with a force sufficient to overcome the spring forces acting on the member, and wherein the gear unit arrangement moves the trigger element into its active limit position exclusively when the second piston-piston rod unit contacts its outer stop and the third piston-piston rod unit contacts its inner stop.

In this way, short-term on and off switching processes (stop-and-go behavior) can also be prevented.

It is known to provide a water heater, e.g. containing an oil burner as heat source, in an installation of the type mentioned above to heat the conveyed working fluid. To avoid damage to the installation by overheating, it should be ensured that the water heater will only be active when the working fluid to be heated is below a certain pressure and also that at least a minimum quantity of working fluid is being conveyed, i.e. that working fluid emerges at the pressure outlet of the installation (e.g. at the spray nozzle of a hand valve).

This problem is solved in a further development according to the invention in that a limit switch is arranged with its actuating lever in the movement path of a cam fixed at the third piston-piston rod unit, in that the cam moves the limit switch into the ON position when this piston-piston rod unit is located at or near its outer limit position which corresponds to contact at the outer stop, and in that the electric connections of the water heater are connected in series with the electric connections of the limit switch and pressure switch to the mains or to a main switch.

The electric connections of the water heater are preferably connected to a time switch which in turn is connected in series with the electric connections of the limit switch and pressure switch, and the time switch connects voltage to the electric connections of the water heater with a delay after its own excitation.

Further features and advantages of the invention can be seen from the claims and the following description of embodiment examples of the invention with reference to the drawings.

Figure 1:
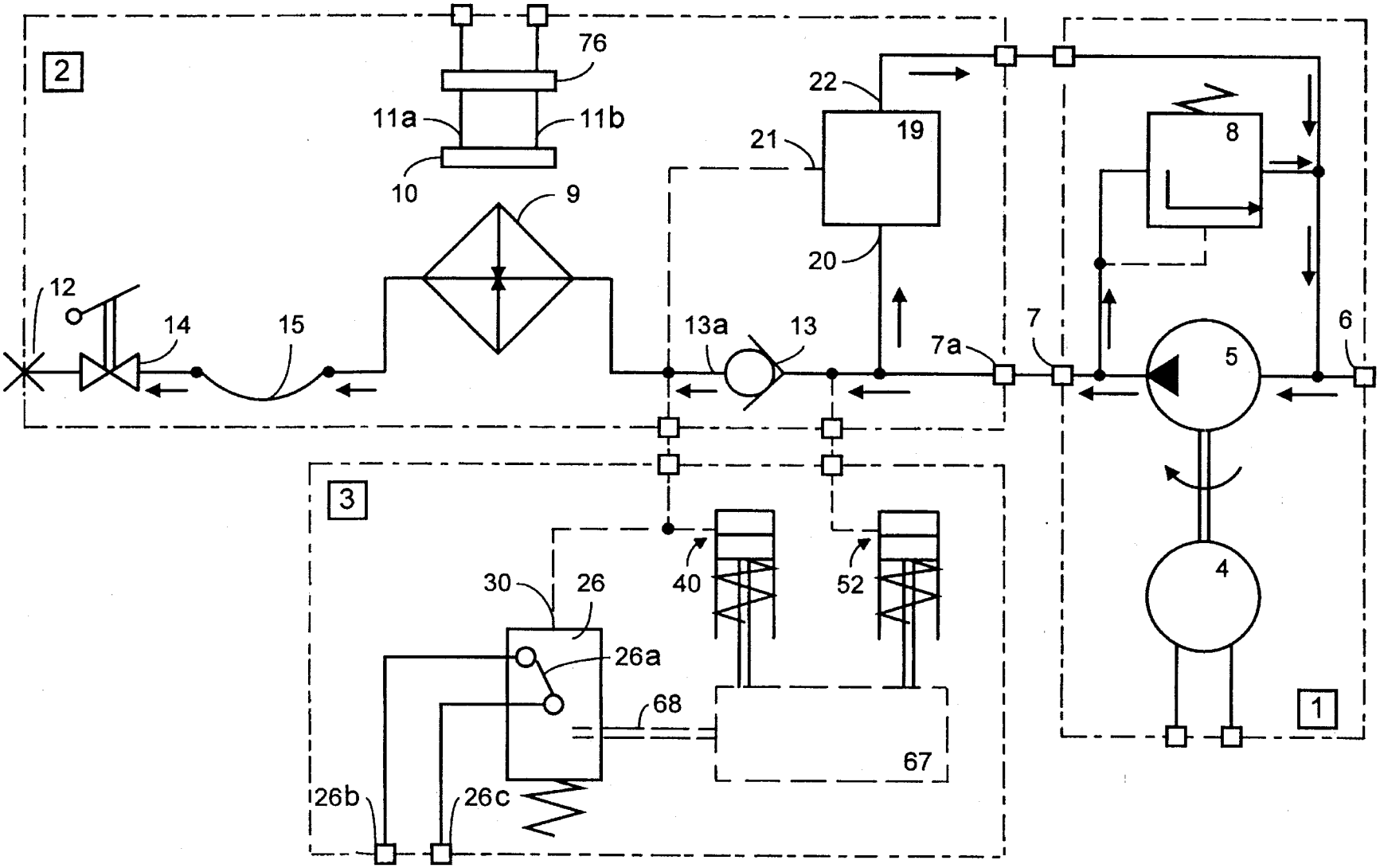
FIG. 1 shows a circuit diagram of the overall installation.

In the above drawings and related text, reference is made to the Appendix for a complete list of reference numerals.

GENERAL REMARKS AND DEFINITIONS

The following remarks, which also apply to the claims, will serve as a prefatory explanation for the following description of the embodiment examples:

Concrete pressure data are provided to facilitate understanding. However, only the degrees of pressure are important for the function of the subject matter of the invention. The numerical values given for the individual pressures depend on the specific area of use of the installation.

Unless otherwise expressly noted, "stationary" signifies that the position of a structural component part in the operating state of the device is fixed in relation to the switch frame of the pressure switch.

The various component groups designated as "cylinder-piston arrangements" can be replaced by arrangements having the same technical operation which change the spatial position of a member in preferably linear movement as a function of the pressure of a fluid acting on them, e.g. diaphragm or bellows arrangements.

"Working fluid" or "fluid" is understood to mean the fluid conveyed through the installation and delivered at its pressure outlet, generally water which can contain additions such as cleaning agents or the like.

DESCRIPTION OF THE PREFERRED EMBODIMENT

As shown in FIG. 1, the installation in its entirety comprises the following subassemblies or component groups which will be explained in more detail in the following with reference to the additional figures:

pressure generating unit designated in its entirety by 1, valve component group designated in its entirety by 2, pressure switch unit designated in its entirety by 3.

The pressure generating unit 1 (FIG. 1) contains a pump 5 driven by a motor 4 with a suction connection 6 and a pressure connection 7. The working fluid is admitted to-the suction connection 6. Normally, the working fluid is supplied at a slight pressure (a few bar) already, e.g. by connection to a drinking water supply network. A safety valve (overflow or pressure-relief valve) 8 which is adjusted to a triggering pressure p-ü of 165 bar is connected between the pressure connection 7, at which the working fluid leaves the pressure generating unit, and the suction connection 6.

The pressure generating unit 1 may also optionally contain a water heater 9 which serves to heat the working fluid and preferably has an oil burner as heat source 10. The heat source is switched on by applying voltage to its electric connections 11*a*, 11*b*. However, the water heater 9 is advantageously arranged in such a way that it is one of the last structural components through which the working fluid flows before exiting the valve component group 2 and thus the entire installation at its pressure outlet 12.

Figure 3:
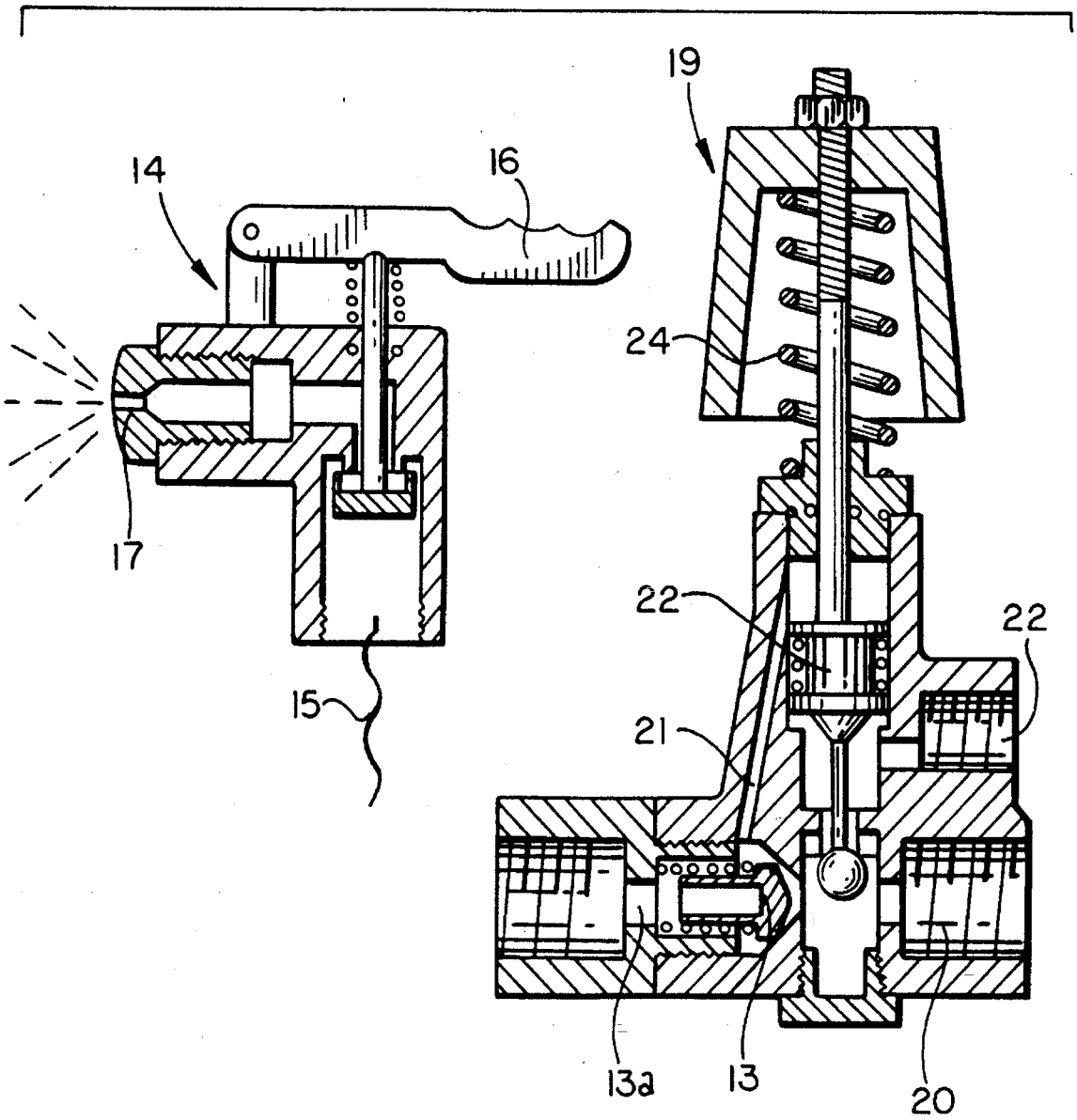
FIG. 3 shows a schematic view in partial section of the relief valve, check valve, and the outlet valve which are contained in the valve subassembly or component group, which outlet valve is constructed as a hand valve.

The valve component group 2 (FIG. 1 and FIG. 3) is connected by its pressure inlet 7*a* to the pressure connection 7 of the pressure generating unit 1. It contains, consecutively in the flow direction, a check valve 13 connected with the pressure inlet and an outlet valve 14 connected with its outlet side 13*a*. The outlet valve 14 serves to block or release the working fluid which is provided by the installation at its pressure outlet 12 at high pressure. In the majority of cases, the outlet valve is formed by a hand valve which is connected with the outlet side 13*a* of the check valve 13 via a hose 15 and contains an actuating lever 16, a valve spigot controlled by the latter, and a spray nozzle 17. But the outlet valve can also be constructed differently, e.g. as a magnetic valve.

The valve component group 2 also contains a relief valve 19 Whose input 20 is connected to the pressure inlet 7*a* and whose control input 21 is connected to the outlet side 13*a* of the check valve 13 and whose output 22 is connected to the suction connection 6 of the pressure generating unit 1. .The relief valve contains a piston 23 which is displaceable in a cylinder bore and is pretensioned in the direction of a first limit position by a valve spring 24 whose force is adjustable. The piston 23 can be displaced against the spring action in the direction of a second limit position as a function of the pressure applied to it via the control input 21 and in so doing lifts a valve body 25 from its seat and opens a flow path for the working fluid from the input 20 to the output 22 and accordingly to the suction connection 6.

Figure 2:
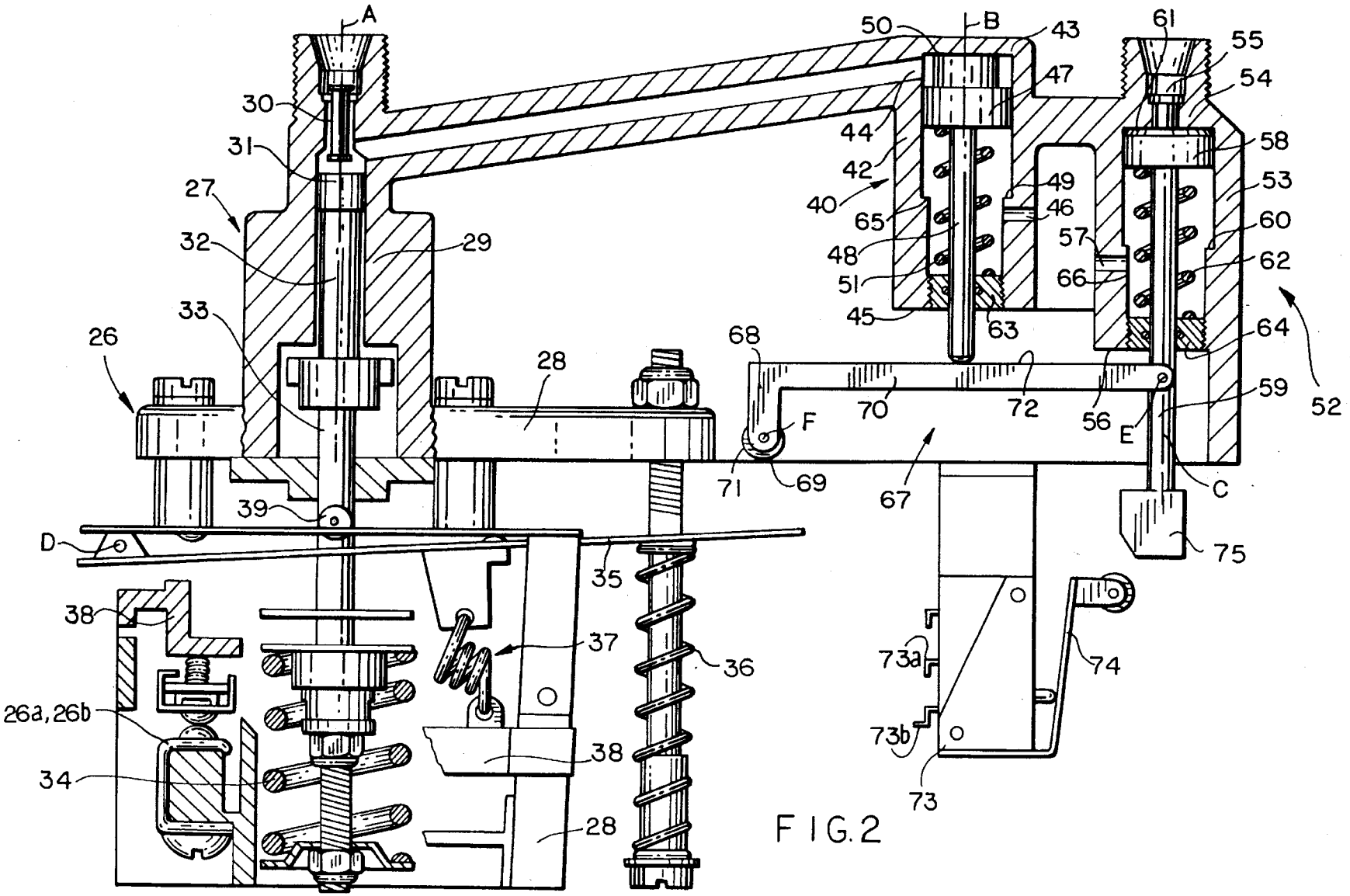
FIG. 2 shows a schematic view in partial section of the pressure switch unit illustrated in FIG. 1.
Figure 2A:
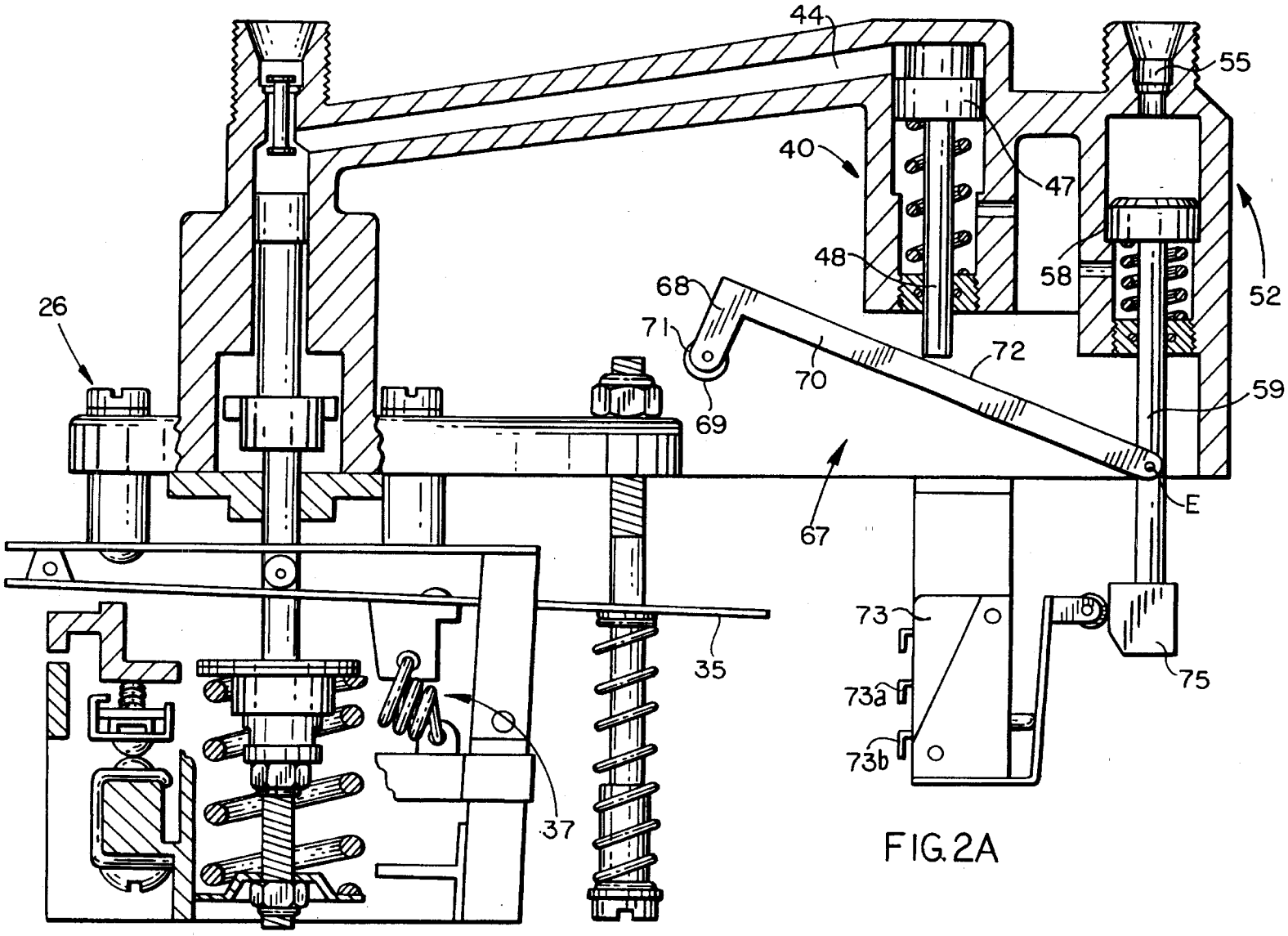
FIGS. 2A to 2D of FIG. 2 show corresponding views of the pressure switch unit in various operating states.
Figure 2B:
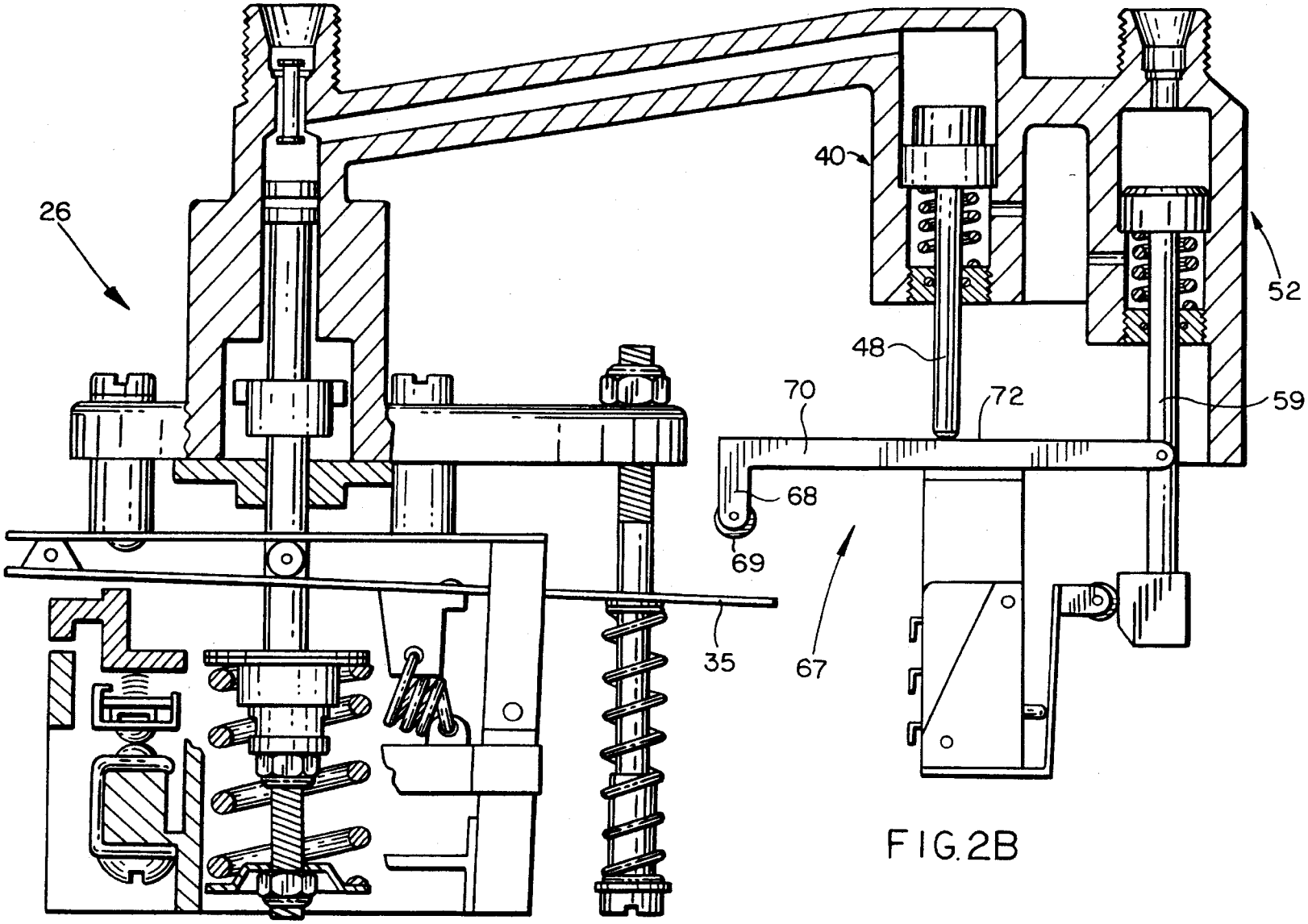
Figure 2C:
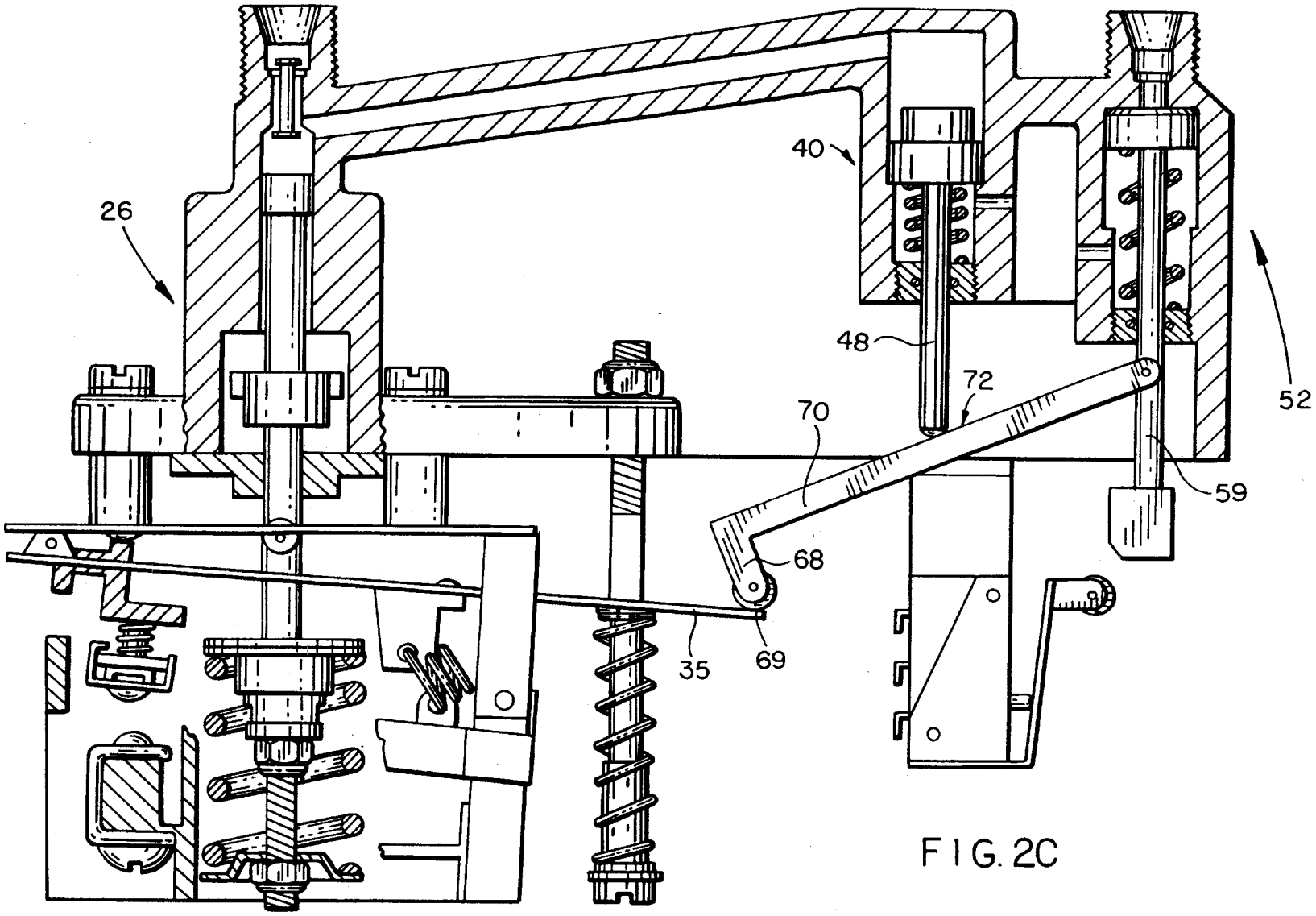
Figure 2D:
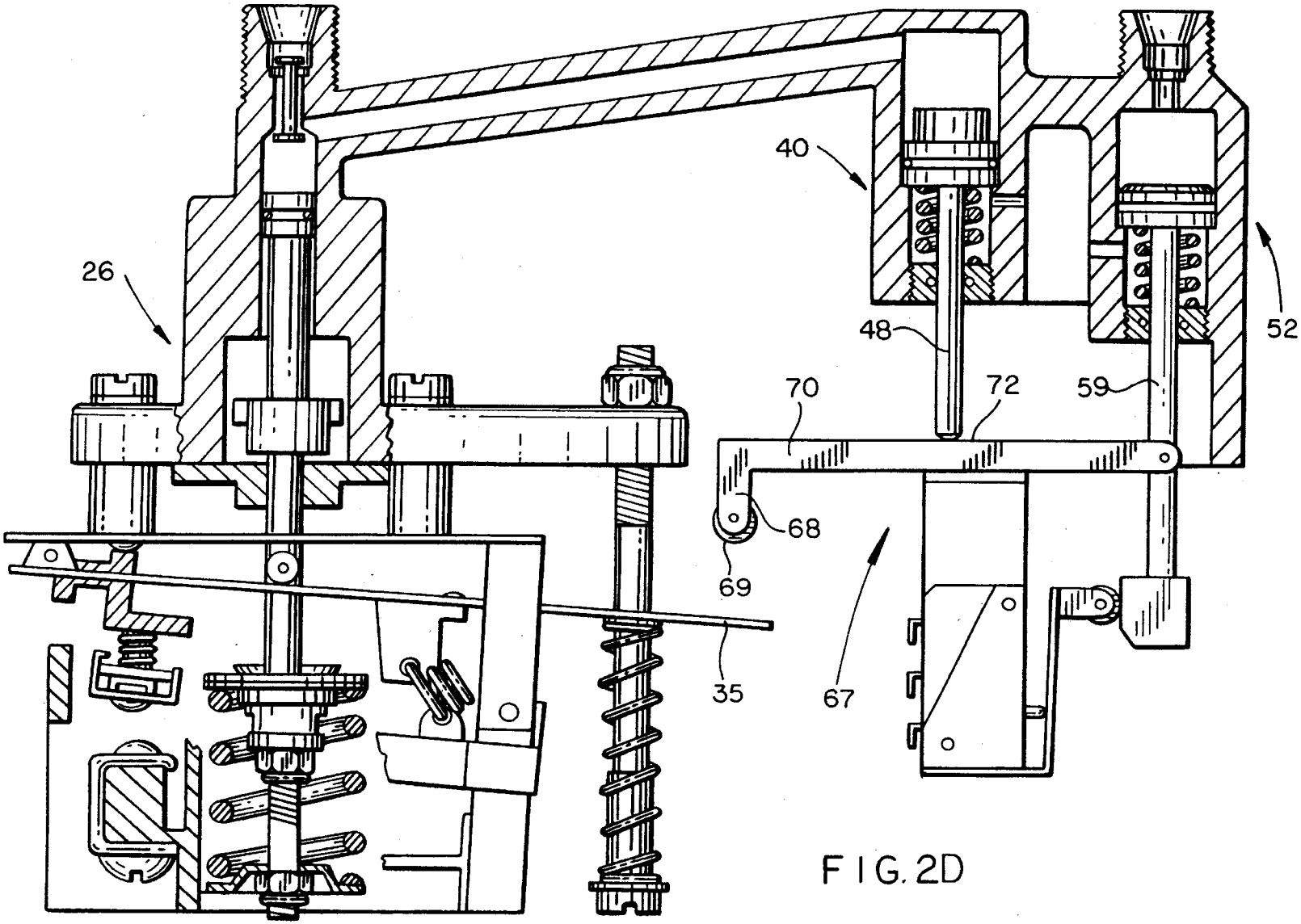

The pressure switch unit 3 (FIGS. 1 and 2) contains a pressure switch 26 (FIG. 2) which is designed for a large on-off switching differential, i.e. at a switch-on pressure p-1*a* of 20 bar it moves its movable contacts 26*a* into an ON position in which the latter produce a connection between its electric connections 26*b*, 26*c* and at a switch-off pressure p-1*b* (nominal pressure of the installation) of 150 bar it moves into an OFF position. The operator sets the desired pressure at the pressure outlet 12 of the installation by adjusting the relief valve (changing the tension of the valve spring 24). A corresponding readjustment of the pressure switch 26 during such an adjustment of pressure is not required, nor is it necessary to construct the pressure switch 26 so as to be adjustable depending on operation.

The pressure switch 26 has a first cylinder-piston arrangement, designated in its entirety by 27, with a longitudinal axis A (which also defines the longitudinal axis of the pressure switch). This arrangement contains a first cylinder 29 which is fixed at the switch frame 28 and, in the region of its base which is otherwise closed, has a first pressure connection 30 for the working fluid which is connected with the outlet side 13*a* of the check valve 13. The cylinder 29 communicates with the open atmosphere in the region of its free end remote of the base. A piston 31 which is securely connected with a piston rod 32 and is constructed at its free end as a fork-shaped body 33 is displaceable in the cylinder. The lift or stroke of the piston-piston rod unit 31, 32 is limited at one side by an inner stop which defines a first limit position and is formed by the contacting of the body 33 at the free end of the cylinder 29.

In a movement proceeding from the inner stop, the body 33 strikes a heavy pretensioned work spring 34 supported at the switch frame 28 after a given idle or free stroke. An intermediate member 35 is supported in the switch frame so as to be swivelable around a swivel axis D which is vertical to the longitudinal axis A. The intermediate member 35 is pretensioned in the direction of a first limit position by another spring 36 (hereinafter designated as first spring) and, via a locking arrangement 37, drives a contact carrier 38 which holds the movable contacts 26*a* and is movably supported in the switch frame. The intermediate member 35 is pressed against rollers 39 supported by the body 33 by the first spring 36. It therefore follows in a positive-locking manner a movement of the body 33 proceeding from the first limit position, but can also be brought into its second limit position and lifted from the rollers 39 by an external actuating force N (see also the trigger element described below) which is sufficient to overcome the spring 36 and the tension of the locking arrangement 37. The locking arrangement 37 causes the contact carrier 38 to move into its OFF position already before reaching the second limit position.

Further, the pressure switch unit 2 has a second cylinder-piston arrangement with a longitudinal axis B, designated in its entirety by 40. This second cylinder-piston arrangement contains a stationary second cylinder 42 which has in the region of its base 43, which is closed otherwise, a pressure connection 44 for the working fluid which is connected with the outlet side 13*a* of the check valve 13. A relief opening 46 communicating with the open atmosphere is provided in the region of the free end 45 of the cylinder remote of the base. A second piston 47 which is securely connected with a piston rod 48 is displaceable in the cylinder 42. An outer stop 49 defines the stroke of the second piston-piston rod unit 47, 48 in the direction of the free end of the cylinder and an inner stop 50 defines the stroke of the second piston-piston rod unit 47, 48 in the direction of the cylinder base 43.

A second spring 51 is supported by one of its ends so as to be stationary and, with its other end, pretensions the second piston-piston rod unit 47, 48 in the direction of the cylinder base 43, i.e. toward the inner stop 50. This spring is designed in such a way that the piston-piston rod unit 47, 48 contacts the inner stop 50 until a second lower pressure p-2*a* of approximately 38 bar is reached at the pressure connection 44. When the pressure is increased, it is lifted from this stop, moves in the direction of the outer stop 49, and contacts the outer stop without force at a second upper pressure p-2*b* of 40 bar. When the pressure is increased further, the piston-piston rod unit remains in the position determined by the outer stop, which stop 49 absorbs the force exerted by the piston 47.

The pressure switch unit 2 further includes a third cylinder-piston arrangement with a longitudinal axis C, designated in its entirety by 52. This third piston-cylinder arrangement 52 contains a stationary third cylinder 53 which has in the region of its base 54, which is otherwise closed, a pressure connection 55 for the working fluid which is connected with the pressure inlet 7*a* of the valve component group 2. A relief opening 57 communicating with the open atmosphere is provided in the region of the free end 56 of the cylinder remote of the base. A third piston 58 which is securely connected with a piston rod 59 is displaceable in the cylinder 53. An outer stop 60 defines the stroke of the third piston-piston rod unit 58, 59 in the direction of the free end of the cylinder and an inner stop 61 defines the stroke of the second piston-piston rod unit 58, 59 in the direction of the cylinder base 54.

A third spring 62 is supported by one of its ends so as to be stationary and, with its other end, pretensions the second piston-piston rod unit 58, 59 in the direction of the cylinder base 54, i.e. toward the inner stop 61. This spring is designed in such a way that the piston-piston rod unit 58, 59 contacts the inner stop 61 until a third lower pressure p-3*a* of approximately 28.5 bar is reached at the pressure connection 55. When the pressure is increased, the piston-piston rod unit 58, 59 is lifted from this Stop and moves in the direction of the outer stop 60 and contacts the outer stop without force at a third upper pressure p-3*b* of 30 bar. When the pressure is increased further, the piston-piston rod unit remains in the position determined for it by the outer stop, wherein this stop absorbs the force exerted by the piston 58.

In the preferred embodiment form shown in the drawing, the free ends of the second and third cylinders 42/53 are provided in each instance with a cover 63/64. The piston rod 48/59 is guided in the central bore hole of the cover 63/64 and the spring 51/62 is constructed as a helical pressure spring which encloses the piston rod 48/59 and is clamped in or tensioned between the inside of the cover and the piston 47/58. Further, the inner stop 50/61 is formed by a central projection at the base of the piston which can contact an inner surface of the cylinder base 43/54 and the outer stop 49/60 is formed by a member 65/66 (e.g. a sleeve enclosing the spring and supported at the cover) which projects from the inner wall of the cylinder and on which the piston can come to rest.

The longitudinal axes A, B, C of the first, second and third cylinder-piston arrangements 27/40/52 lie in a common longitudinal plane and extend parallel to one another. All three cylinder-piston arrangements 27/40/52 are identically directed, i.e. their piston-piston rod units. 31,32/47,48/58,59 move in the same direction when the pressure is increased.

The pressure switch unit also includes a gear unit arrangement, designated in its entirety by 67, which is driven by the second piston-piston rod unit 47, 48 and by the third piston-piston rod unit 58, 59. The gear unit arrangement 67 contains a movable trigger element 68 having a pressing surface 69 which can be moved out of a first inactive limit position into a second active limit position (and back) by the gear unit arrangement 67.

In the inactive limit position, the pressing surface 69 and the trigger element 68 are located outside the movement path of the intermediate member 35 of the pressure switch 26 and in the active limit position are located inside the movement path of the intermediate member 35 of the pressure switch 26. Further, the arrangement is effected in such a way that when moving from the inactive to the active limit position, the pressing surface 69 can come to rest at the intermediate member 35 while exerting a pressure force N and can move the latter in the direction of its second limit position at least far enough so that the locking arrangement 37 moves the movable contacts **26*a* into the OFF position, i.e. acts on the intermediate member in the same sense as the first piston-piston rod unit 31, 32 by means of its rollers 39. As was already mentioned earlier, the intermediate member 35 is lifted from the rollers 39 so that it can be moved only by overcoming the sum of the forces exerted on the intermediate member by the first spring 36 and the locking arrangement 37 without having to carry along the piston-piston rod unit 31, 32**.

The fundamental function of the gear unit arrangement 67 consists in determining the position of the trigger element 68 depending on the position occupied by the second and third piston-piston rod units 47,48/59,60. More exactly, the gear unit arrangement moves the trigger element into the active limit position mentioned above when and only when the second piston-piston rod unit 47, 48 is located at its outer stop 49 (or immediately adjacent to it) and the third piston-piston rod unit 59, 60 contacts its inner stop 61 (or,is located immediately adjacent to it).

This also means that the trigger element 68 is moved into the active limit position by the gear unit arrangement 67 and accordingly moves the pressure switch 26 into its OFF position when, as a first condition, the pressure at the outlet side **13*a* of the check valve 13 (which corresponds to the pressure at the installation outlet valve 14) is equal to or greater than the upper second pressure p-2*b* of 40 bar and, in any case, greater than the lower second pressure p-2*a* of 38 bar and when, as second condition, the pressure at the pressure inlet 7*a* of the valve component group 2 is equal to or less than the lower third pressure p-2*a* of 28.5 bar and, in any case, less than the upper third pressure p-2*b*** of 30 bar.

A person skilled in the art can easily realize a gear unit arrangement 67 appropriate for the invention based on the operation described in the preceding. A particularly simple embodiment form of the gear unit arrangement 67 shown in FIG. 2 has a lever 70 which is fastened by its first end to the third piston rod 59 with a joint whose axis E extends parallel to the swivel axis D of the intermediate member 35 contained in the pressure switch 26 and vertical to the common longitudinal plane containing the longitudinal axes A,B,C of the three cylinder-piston arrangements. The lever 70 can therefore carry out a swiveling movement in this plane (practically the drawing plane of FIG. 2).

The pressing surface 69 which is constructed as a roller 71 with rotational axis F parallel to the joint axis E for the purpose of reducing friction is located at the second, free end of the lever 70. A contact surface 72 contacted by the free end of the second piston rod 48 is located between the two ends of the lever 70. The lever 70 therefore also forms the trigger element 68 with its region adjoining the free end.

A limit switch 73, e.g. a micro-switch, is so arranged with its actuating lever 74 in the movement path of a cam 75 fastened at the third piston-piston rod unit 58,59 that it produces a conducting connection between its electric connections **73*a*, 73*b* when the piston-piston rod unit has been lifted from its inner stop 59 and approaches its outer stop 60. The limit switch 73 is therefore always moved into the 0N position when the pressure in the third cylinder-piston arrangement 52, and accordingly the pressure at the pressure inlet 7*a* of the valve component group 2, exceeds the third lower pressure p-3*a*** of 28.5 bar.

A time switch (timed relay) 76 is connected in series with the electric connections **26*b*,26*c*/73*a*,73*b* of the pressure switch 26 and the limit switch 73 to the mains or to a main switch. This time switch is connected in turn with the electric connections 11*a*, 11*b* of the heat source (oil burner) 10 of the water heater 9 in such a way that the heat source is only put into operation after a predetermined time delay after voltage has been applied to the time switch 76, i.e. after the pressure switch 26 and the limit switch 73 have reached the 0**N position.

If the first spring 36 of the pressure switch 26 has a relatively high pressure force corresponding to the constructional form of the pressure switch 26 which cooperates with the gear unit arrangement 67 and/or if the second cylinder-piston arrangement 40 is designed in such a way that its pressure force just suffices to move the intermediate member 35 into its second limit position via the gear unit arrangement, an unstable position of equilibrium of this cylinder-piston arrangement can damage its operation. This instability occurs when the value p-**2*b* of 40 bar is reached when the second pressure drops and the hydraulic force at the piston 47 is in equilibrium with the force of the second spring 51 (force-free contacting of the second piston-piston rod unit 47, 48 at the outer stop 49). If the third piston-piston rod unit moves toward its inner stop 61 in this state, a force is exerted via the lever 70 supported at its pressing surface 69 at the intermediate member 35, which force displaces the second piston-piston rod unit in the direction of its inner stop 50**.

Figure 4:
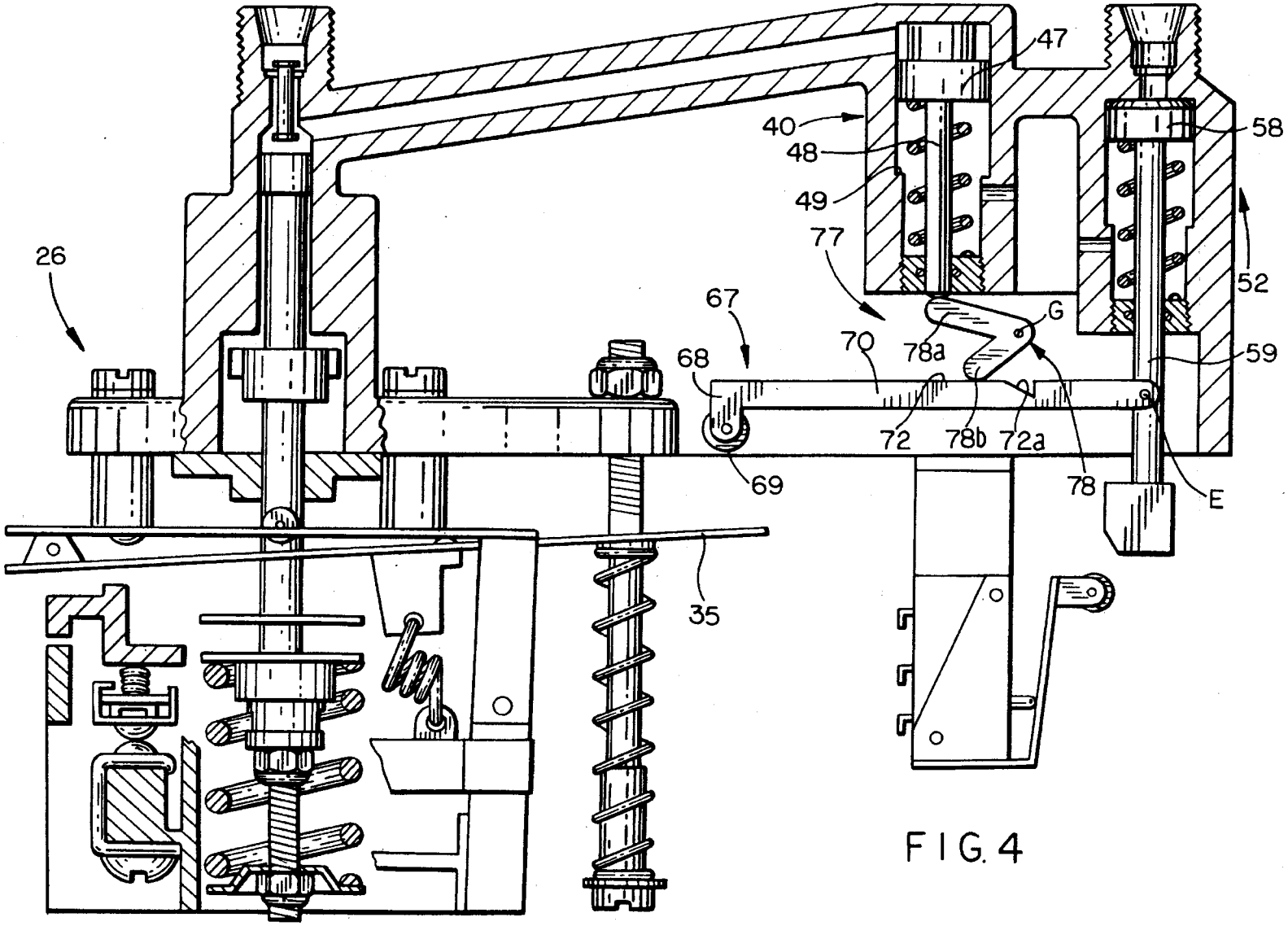
FIG. 4 shows a schematic view in partial section of the pressure switch unit with a modified construction form of the gear unit arrangement contained therein.
Figure 4A:
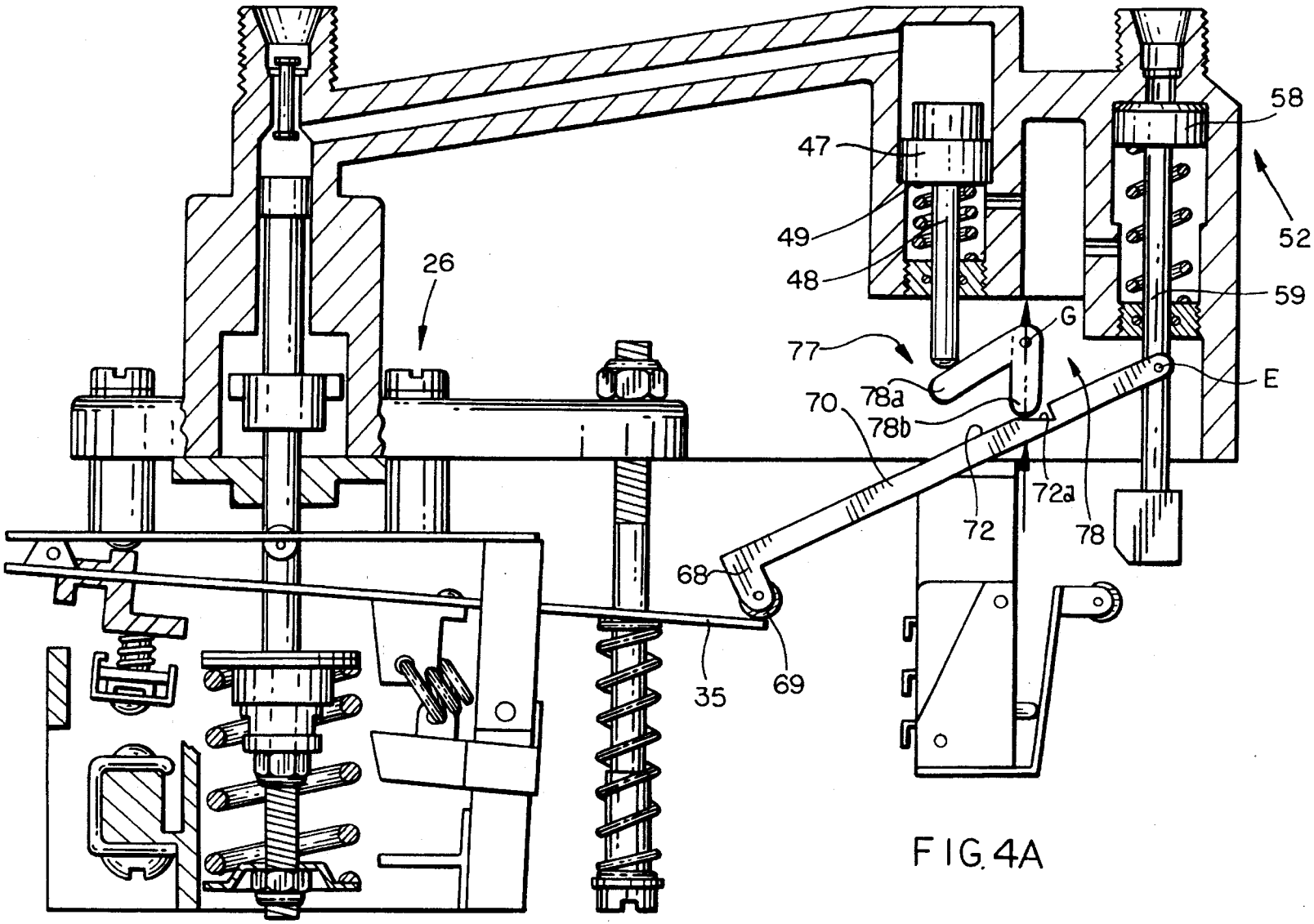
FIG. 4A shows a view of the modified embodiment form corresponding to FIG. 4 in a different operating state.

This problem can be overcome in a simple manner in a modified embodiment form as explained in FIGS. 4 and 4A, i.e. by means of a blocking device designated in general by 77. This blocking device could also be realized in a different manner, e.g. by a displaceably supported locking bolt.

According to the embodiment form shown in the drawing, a two-arm angle lever 78 which is swivelable around a stationary joint axis G is provided as a blocking device. This joint axis G penetrates the angle lever in the vicinity of the junction of its two legs 78*a* and 78*b*. The first leg 78*a* contacts the free end of the second piston-piston rod unit 47, 48. The second leg 78*b* has, at its free end, a sliding surface 79 which contacts the contact surface 72 of the lever 70. This contact surface 72 contains a portion 72*a* which is constructed as one of the defining surfaces of a triangular notch of the lever 70. The position and alignment of the portion 72*a* and the position of the joint axis G of the angle lever 78 are selected in such a way that the sliding surface 79 at the second leg 78*b* contacts the portion 72*a* when a second piston-piston rod unit 47, 48 contacts the outer stop and a third piston-piston rod unit 58, 59 contacts the inner stop 61 and that a straight line passing through the point of contact and through the joint axis G is at least approximately perpendicular to the portion.

The lever 70 is accordingly supported via the joint axis G so that the lever can rotate in an articulated manner around the sliding surface 79 with its contact surface portion 72*a* (regardless of whether or not the second piston-piston rod unit 47, 48 is in an unstable state) and brings its trigger element 68 into the active limit position (conditional OFF position of the limit switch 26) when the third piston-piston rod unit 58, 59 moves toward its inner stop 61.

A restoring spring (not shown in the drawing) or a friction-locking or positive-locking connection of the second leg with the second piston-piston rod unit causes the angle lever 78 to leave its blocking position when the second piston-piston rod unit returns to its drawn in position.

The operation of the regulating and controlling device follows from FIG. 2 and FIGS. 2A to 2D (from FIGS. 4 and 4A for the modified embodiment form) which illustrate the additional operating states. Therefore, it will suffice to explain this operation by a few key words. In so doing, the following initial position (FIG. 2 and FIG. 4) is assumed:

The installation is cut off from the mains by the main switch;

the installation is without pressure; the outlet valve 14 is closed;

the safety valve 8 is adjusted to a pressure p-ü of 165 bar;

the pressure switch 26 is designed for a switch-on pressure p-1*a* of 20 bar and for a switch-off pressure p-1*b* of 150 bar and is in the ON position the second piston-piston rod unit 47, 48 of the second cylinder-piston arrangement 40 contacts the inner stop 50 until a pressure p-2*a* of 38 bar is reached, begins to move out as pressure increases, and reaches the outer stop 49 at a pressure p-2*b* of 40 bar;

the third piston-piston rod unit 58, 59 of the third cylinder-piston arrangement 52 contacts the inner stop 61 until a pressure p-3*a* of 28.5 bar is reached, begins to move out as pressure increases, and reaches the outer stop 49 at a pressure of 30 bar;

the relief valve is adjusted to 100 bar.

A. The main switch is switched on, the motor 4 is connected to the mains via the pressure switch 26 and the pump 5 starts to run.

B. The pump pressure exceeds 28.5 bar; the third piston-piston rod unit 58, 59 of the third cylinder-piston unit 52 moves toward the outer stop 61 and reaches it at 30 bar (FIG. 2A, FIG. 4); the cam 75 moves the limit switch 73 into the 0N position; the heat source 10 of the water heater 9 is switched on via the time switch 76.

C. The pump pressure exceeds, 38 bar; the second piston-piston rod unit 47, 48 of the second cylinder-piston arrangement 40 moves toward the outer stop 60 and reaches it at 40 bar (and is locked in this position by the angle lever 78 in the modified embodiment form).

D. The pump pressure reaches 100 bar; the relief valve 19 opens and guides the delivered working fluid back to the suction connection 6 of the pump 5; the resulting drop in the pump pressure to a value close to zero (also pressure prior to the check valve); this drop in pressure causes the second piston-piston rod unit to return to the inner stop; it has no affect on the open position of the relief valve, since the control input 21 of the latter is connected to the outlet side 13*a* of the check valve 13 and the original pressure of 100 bar is maintained by it; for the same reason the second piston-piston rod unit 47, 48 also remains at its outer stop.

E. Due to the aforementioned positions of the second and third piston-piston rod units, the trigger element 58 (situated at the lever 70) is brought into its active limit position by the gear unit arrangement 67; the intermediate member 35 of the pressure switch 26 is accordingly moved in the direction of its second limit position until the pressure switch moves into the OFF position; the motor is switched off.

F. By opening the outlet valve 14 of the installation (or leakage), the pressure at the check valve outlet side 13*a* drops to 40 bar; the second piston-piston rod unit 47, 48 moves to its inner stop; the gear unit arrangement 67 moves the trigger element 68 into its inactive position; the intermediate member 35 is released;

G. The pressure drops to 20 bar; the pressure switch 26 moves into the ON position: the motor 4 is switched on; the pump 5 continues to pump.

I. As the outlet valve 14 remains open (and with a certain flow resistance, e.g. due to a connected spray nozzle), the pressure which is regulated by the relief valve 19 increases to the adjusted 100 bar at the check valve outlet side 13*a;* in so doing, a portion of the working fluid delivered by the pump recirculates to the suction connection 6 of the pump.

K. The outlet valve 14 of the installation is closed, there begins a cycle analogous to the preceding item E, and following.

While the foregoing description and drawings represent the preferred embodiments of the present invention, it will be obvious to those skilled in the art that various changes and modifications may be made therein without departing from the true spirit and scope of the present invention.

List of Reference Numbers (Appendix)

1 pressure generating unit
2 valve component group
3 pressure switch unit
4 motor
5 pump
6 suction connection of the pump and of the pressure generating unit
7*a* pressure inlet
8 safety valve
9 water heater
10 heat source of the water heater (oil burner)
11*a*, 11*b* electric connections of the heat source constructed as oil burner
12 pressure outlet of the entire installation for removal of the working fluid under high pressure
13 check valve
13*a* outlet side of check valve
14 outlet valve
15 hose 16 actuating lever of the outlet valve constructed as hand valve
17 spray nozzle of the outlet valve constructed as hand valve
18 not used
19 relief valve
20 input of relief valve
21 control input of relief valve
22 outlet of relief valve
23 piston of relief valve
24 adjustable valve spring of relief valve
25 valve body of relief valve
26 pressure switch
26*a* a movable contacts of pressure switch
26*b*, 26*c* electric connections of pressure switch
27 first cylinder-piston arrangement in its entirety
28 switch frame
29 first cylinder fixed at switch frame of pressure switch
30 first pressure connection of pressure switch or of first cylinder-piston arrangement;
31 first piston of the first cylinder-piston arrangement
32 piston rod
31, 32 first piston-piston rod unit
33 fork-shaped body at first piston rod
34 working spring in lift region of body
35 swivelable intermediate member
36 first spring pretensioning intermediate member
37 locking arrangement
38 swivelably supported contact carrier
39 rollers supported by body
40 second cylinder-piston arrangement in its entirety
41 not used
42 second, stationary cylinder of second cylinder-piston arrangement
43 base of second cylinder
44 second pressure connection of second cylinder-piston arrangement
45 free end of cylinder of second cylinder-piston arrangement
46 relief opening
47 second piston of second cylinder-piston arrangement
48 second piston rod
47, 48 second piston-piston rod unit
49 outer stop of second piston-piston rod unit
50 inner stop of second piston-piston rod unit
51 second spring pretensioning second piston-piston rod unit
52 third cylinder-piston arrangement in its entirety
53 third, stationary cylinder of third cylinder-piston arrangement
54 base of third cylinder
55 third pressure connection of third cylinder-piston arrangement
56 free end of cylinder of third cylinder-piston arrangement
57 relief opening
58 third piston of third cylinder-piston arrangement
59 third piston rod
58, 59 third piston-piston rod unit
60 outer stop of third piston-piston rod unit
61 inner stop of third piston-piston rod unit
62 third spring pretensioning third piston-piston rod arrangement
63 cover of second cylinder
64 cover of third cylinder
65 projecting member of second cylinder
66 projecting member of third cylinder
67 gear unit arrangement in its entirety
68 trigger element
69 pressing surface of trigger element
70 lever
71 roller at lever
72 contact surface of lever
72*a* portion of contact surface
73 limit switch (micro-switch)
73*a*, 73*b* electric connections of limit switch
74 actuating lever of limit switch
75 cam at third piston-piston rod unit
76 time switch
77 blocking device
78 angle lever
78*a* first leg of angle lever
78*b* second leg of angle lever
79 sliding surface at free end of second leg
A longitudinal axis of first cylinder-piston arrangement, also longitudinal axis of pressure switch
B longitudinal axis of second cylinder-piston arrangement
C longitudinal axis of third cylinder-piston arrangement
D swivel axis of intermediate member, vertical to first longitudinal axis
E joint axis of lever, vertical to common longitudinal plane of cylinder-piston arrangements
F rotational axis of roller at lever
G joint axis of angle lever
N external actuating force overcoming spring forces acting on intermediate member
p-1*a* first, lower switch-on pressure (20 bar) of pressure switch at first cylinder-piston arrangement
p-1*b* first, upper switch-off pressure (150 bar) of pressure switch at first cylinder-piston arrangement and nominal pressure of installation
p-2*a* second, lower pressure (38 bar) at second cylinder-piston arrangement
p-2*b* second, upper pressure (40 bar) at second cylinder-piston arrangement
p-3*a* third, lower pressure (28.5 bar) at third cylinder-piston arrangement
p-3*b* third, upper pressure (30 bar) at third cylinder-piston arrangement
p-ü pressure (165 bar), trigger pressure adjusted at safety valve

What is claimed is:

1. A regulating and controlling device for a fluid pressure booster installation comprising:

a pressure generating unit with a pump which is driven by a motor, said unit having a suction connection supplied by a working fluid whose pressure is to be increased, said unit also-having a pressure connection connected with a check valve, said check valve having an outlet side connected to a pressure outlet of the installation from which the working fluid can be removed at high pressure;

a relief valve whose pressure can be adjusted depending on operation, said relief valve having an input connected with said pressure connection, said relief valve also having an output connected with said suction connection and a control input connected with said outlet side of said check valve;

a pressure switch having a large ON-OFF switching differential for connecting the motor to the electrical mains and which switch contains a first cylinder-piston arrangement which is connected with said outlet side of the check valve, said first cylinder-piston arrangement having a piston rod for contacting an intermediate member which is movably supported in a frame of said switch, is pretensioned in the direction of a first limit position by a first spring and is coupled with a movable contact carrier via a locking arrangement;

wherein the intermediate member moves said contact carrier from an ON position into an OFF position in a movement which proceeds from the first limit position occupied by the cylinder-piston arrangement in the absence of pressure and is directed toward a second limit position, wherein the intermediate member moves said contact carrier into the 0N position before reaching the first limit position at a first lower pressure with an opposite movement which is effected by the driving of said first spring against an oppositely directed force of the first cylinder-piston arrangement, and wherein the intermediate member, proceeding from a position predetermined by said first cylinder-piston arrangement, can be moved further in the direction of its second limit position by an external force by overcoming the sum of spring forces of said first spring and locking arrangement;

a second cylinder-piston arrangement having a stationary second cylinder, said second cylinder-piston arrangement having a pressure connection which is connected with said outlet side of the check valve and having a piston-piston rod unit, which is pretensioned by a second spring against an inner stop defining a moved-in state, which is lifted from the inner stop when the pressure connection is acted upon by a second lower pressure and which comes to rest at an outer stop at a slightly greater second upper pressure;

a third cylinder-piston arrangement having a stationary third cylinder, said third cylinder-piston arrangement having a pressure connection which is connected with the pressure connection of the pressure generating unit, and having a piston-piston rod unit which is pretensioned by a third spring against an inner stop defining a moved-in state which is lifted from the inner stop when the pressure connection is acted upon by a determined third lower pressure and which comes to rest at an outer stop at a slightly greater third upper pressure, wherein the third upper pressure is greater than the first lower pressure and less than the second upper pressure; and a gear unit arrangement which is driven by said second piston-piston rod unit and by said third piston-piston rod unit and has a trigger element for engaging at said intermediate member of the pressure switch;

wherein said trigger element can be moved from an inactive limit position situated outside of the movement path of said intermediate member into an active limit position in which it acts on said intermediate member with a pressing surface so as to move said intermediate member toward its second limit position with a force sufficient to overcome the spring forces acting on said member, and wherein said gear unit arrangement moves the trigger element into its active limit position only when said second piston-piston rod unit contacts its outer stop and said third piston-piston rod unit contacts its inner stop.

2. The regulating and controlling device for a fluid pressure booster installation, in particular a high-pressure cleaning installation, according to claim 1, wherein longitudinal axes of the second and third cylinder-piston arrangements substantially lie in a common longitudinal plane and extend parallel to one another, wherein said second and third cylinder-piston arrangements face in the same direction, and wherein the gear unit arrangement contains a lever which is fastened by a first end to said third piston rod with a joint with a joint axis vertical to said common longitudinal plane, said lever having a second end which is provided with said pressing surface which forms said trigger element, said lever having a contact surface between the first and second ends, a free end of the second piston rod being able to contact said contact surface while exerting pressure.

3. The regulating and controlling device for a fluid pressure booster installation, in particular a high-pressure cleaning installation, according to claim 2, wherein said lever of the gear unit arrangement is coupled with said second piston-piston rod unit via an angle lever having a joint axis which is stationary and penetrates said angle lever in the vicinity of the junction of two legs of said lever, wherein the first leg of said angle lever contacts the free end of said second piston-piston rod unit, wherein the second leg of the angle lever contacts the contact surface of the lever with a sliding surface which is constructed at its free end, wherein at least the portion of the contact surface contacted by the sliding surface when the second piston-piston rod unit is moved out and when the third piston-piston rod unit is moved in extends substantially vertical to a straight line which vertically intersects the joint axis and passes through the point of contact, and wherein the angle lever is guided after the second piston-piston rod unit by a restoring spring with the second piston-piston rod unit when it moves from the moved-out position back into the moved-in position.

4. The regulating and controlling device for a fluid pressure booster installation, in particular a high-pressure cleaning installation, according to claim 6, wherein the portion of the contact surface forms one of the defining surfaces of a notch which is cut out of the lever.

5. The regulating and controlling device for a fluid pressure booster installation, in particular a high-pressure cleaning installation, according to claim 2, wherein said lever of the gear unit arrangement is coupled with said second piston-piston rod unit via an angle lever having a joint axis which is stationary and penetrates said angle lever in the vicinity of the junction of two legs of said lever, wherein the first leg of said angle lever contacts the free end of said second piston-piston rod unit, wherein the second leg of the angle lever contacts the contact surface of the lever with a sliding surface which is constructed at its free end, wherein at least the portion of the contact surface contacted by the sliding surface when the second piston-piston rod unit is moved out and when the third piston-piston rod unit is moved in extends substantially vertical to a straight line which vertically intersects the joint axis and passes through the point of contact, and wherein the angle lever is guided after the second piston-piston rod unit by a locking engagement with the second piston-piston rod unit when it moves from the moved-out position back into the moved-in position.

6. The regulating and controlling device for a fluid pressure booster installation, in particular a high-pressure cleaning installation, according to claim 5, wherein the portion of the contact surface forms one of the defining surfaces of a notch which is cut out of the lever.

7. The regulating and controlling device for a fluid pressure booster installation, in particular a high-pressure cleaning installation, according to claim 1, wherein longitudinal axes of said second and third cylinder-piston arrangements lie in a common longitudinal plane which is situated in the longitudinal axis of said first cylinder-piston arrangement contained in said pressure switch, wherein said second and third cylinder-piston arrangements face in the same direction as said first cylinder-piston arrangement, and wherein said intermediate member is supported in the switch frame of the pressure switch so as to be swivelable around a swivel axis which is vertical to the common longitudinal plane.

8. The regulating and controlling device for a fluid pressure booster installation, in particular a high-pressure cleaning installation, according to claim 1, wherein a device for keeping the second piston-piston rod unit free from reactive forces, at least when the latter is in the moved-out position, is arranged between said second piston-piston rod unit and said gear unit arrangement.

9. The regulating and controlling device for a fluid pressure booster installation, in particular a high-pressure cleaning installation, according to one claim 1, wherein the gear unit arrangement contains a blocking device which locks the trigger element in its active limit position when said trigger element attains this position and cancels the locking when said second piston-piston rod arrangement assumes its drawn-in position.

10. The regulating and controlling device for a fluid pressure booster installation, in particular a high-pressure cleaning installation, according to claim 1, including a water heater for heating the working fluid, said water heater being contained in the installation and operated by applying voltage to electric connections thereof, wherein a limit switch is arranged with an actuating lever in a movement path of a cam fixed at said third piston-piston rod unit, wherein the cam moves the limit switch into an ON position when said third piston-piston rod unit is located at or near its outer limit position which corresponds to contact at the outer stop, and wherein said electric connections of the water heater are connected in series with the electric connections of said limit switch and pressure switch to the electrical mains or to a main switch.

11. In a regulating and controlling device for a fluid pressure booster installation having a motor-driven pressure generating unit, a check valve, a relief valve, a pressure switch having a first cylinder-piston arrangement for connecting the drive motor of the pressure generating unit to a source of electrical energy, said first cylinder-piston arrangement having a piston rod for contacting an intermediate member which is movably connected to a frame of said switch, and pretensioned by a first spring, and is coupled with a movable carrier, said first cylinder piston having a first lower switch-on pressure and a first upper switch-off pressure, the improvement comprising:

a second cylinder-piston arrangement having a stationary second cylinder, said second cylinder-piston arrangement being pressure-coupled to an outlet of said check valve and having a piston-piston unit which is pretensioned by a second spring against an inner stop defining a moved-in state, which is lifted from the inner stop when the pressure connection is acted upon by a second lower pressure and which comes to rest at an outer stop at a slightly greater second upper pressure;

a third cylinder-piston arrangement having a stationary third cylinder, said third cylinder-piston arrangement having a pressure connection which is common with that of the pressure generating unit and having a piston-piston rod unit which is pretensioned by a third spring against an inner stop defining a moved-in state, which is lifted from the inner stop when the pressure connection is acted on by a determined third lower pressure, and which comes to rest at an outer stop at a slightly greater third upper pressure, wherein the third upper pressure is grater than the first lower pressure and less than the second upper pressure; and a gear unit arrangement which is driven by the second piston-piston rod unit and by the third piston-piston rod unit and has a trigger element for engaging at the intermediate member;

wherein the trigger element can be moved from an inactive limit position situated outside the movement path of the intermediate member into an active limit position in which it acts on the intermediate member with a pressing surface so as to move the intermediate member from a first limit position to a second limit position with a force sufficient to overcome the spring forces acting on the member and wherein the gear unit arrangement moves the trigger element into its active limit position only when the second piston-piston rod unit contacts its outer stop and the third piston-piston unit contacts its inner stop.

* * * * *